US005216911A

United States Patent [19]

Catanese et al.

[11] Patent Number: 5,216,911

[45] Date of Patent: Jun. 8, 1993

[54] AUTOMATIC COLD-PILGER MILL STOP APPARATUS

[75] Inventors: John A. Catanese, Seward; Michael A. McClarren, New Alexandria, both of Pa.

[73] Assignee: Westinghouse Electric Corp., Pittsburgh, Pa.

[21] Appl. No.: 823,403

[22] Filed: Jan. 21, 1992

[51] Int. Cl.[5] ..... B21B 21/04; B21B 39/16

[52] U.S. Cl. ..... 72/4; 72/14; 72/24; 72/214; 72/252

[58] Field of Search ..... 72/4, 21, 24, 214, 14, 72/208, 209, 252

[56] References Cited

U.S. PATENT DOCUMENTS

| | | | |
|---|---|---|---|
| 3,015,974 | 4/1962 | Orbom et al. . | |
| 3,659,446 | 5/1972 | Gerretz et al. . | |
| 3,948,070 | 4/1976 | Hentzschel et al. . | |
| 4,037,444 | 7/1977 | Ledebur et al. | 72/21 |
| 4,037,453 | 7/1977 | Remner et al. | 72/252 |
| 4,100,786 | 7/1978 | Dorp et al. . | |
| 4,562,713 | 1/1986 | Kondoh | 72/24 |

FOREIGN PATENT DOCUMENTS

| | | | |
|---|---|---|---|
| 2461303 | 7/1976 | Fed. Rep. of Germany | 72/214 |
| 42-13377 | 7/1967 | Japan . | |
| 0768508 | 10/1980 | U.S.S.R. | 72/21 |

*Primary Examiner*—Lowell A. Larson
*Assistant Examiner*—Thomas C. Schoeffler
*Attorney, Agent, or Firm*—Joseph C. Spadacene

[57] ABSTRACT

An automatic stop apparatus for use in combination with a cold-pilger mill to reduce the amount of tube scrap generated during a cold-pilgering operation includes a first control scheme for stopping the advancement of the pilger mill feed carriage and the operation of the mill's upper and lower pilger dies when the feed carriage pushing a tube through the pilger dies is a predetermined distance from the axis extending between the centers of the pair of pilger dies. The predetermined distance is selected to provide that facing end portions of the pushed and pusher tubes are positioned between the pilger dies. A second control scheme stops the retraction of the feed carriage after the feed carriage has moved the same predetermined distance measured from the trailing end of the pusher tube towards the inlet end of the pilger mill so that the next pusher tube provides that the upper and lower pilger dies are again stopped when the facing end portions of the succeeding pushed and pusher tubes are also between the pilger dies.

11 Claims, 1 Drawing Sheet

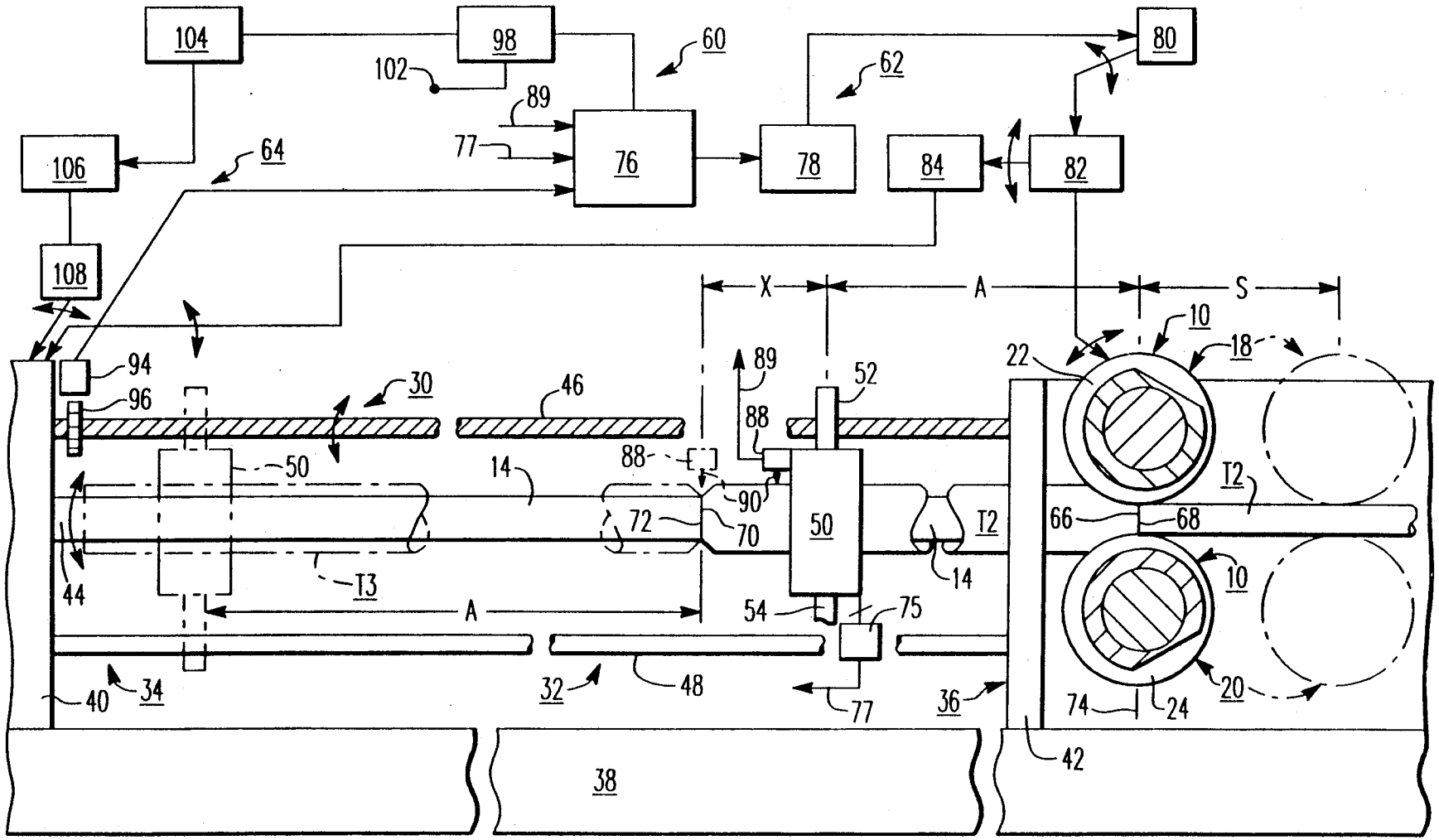
80
82
84
62
78
60
76
98
89
77
102
104
64
106
108
94
96
30
46
14
50
13
A
X
S
10
18
22
12
68
66
20
24
74
42
36
52
75
77
54
48
32
38
34
40
44
88
90
70
72

AUTOMATIC COLD-PILGER MILL STOP APPARATUS

BACKGROUND OF THE INVENTION

1. Field of the Invention

The present invention relates generally to a mill for cold-pilgering thick wall metallic tubes to form thin wall tubes and, more particularly, is concerned with an automatic cold-pilger mill stop apparatus for reducing the amount of tube scrap generated during the cold-pilgering operation.

2. Description of the Prior Art

Cold-pilgering is a conventional tube forming operation by which a tube is simultaneously advanced over a stationary mandrel and compressed using two opposing pilger dies resulting in a reduction in the cross-sectional area and in elongation of the tube. Representative of pilgering mills are the ones disclosed and illustrated in Arrington U.S. Pat. No. 3,416,346, Edstrom et al. U.S. Pat. Nos. 3,487,675 and 3,690,850, Naylor et al. U.S. Pat. No. 4,090,386 and Matinlassi U.S. Pat. No. 4,233,834.

Typically, a relatively thick wall tube is reduced and elongated to a thin wall tube by passing through a succession of stations of the cold-pilgering mill with each station being composed of a stationary mandrel and pilger die set. Reduction is effected in both the diameter and wall thickness of the tube by means of the tapered shape of the mandrel and the circumferential tapered shape of grooves formed in the dies which embrace the tube from above and below the mandrel and roll in a constant cycle back and forth along the outer surface of the tube. Between each cycle of die movement, the tube is advanced and rotated incrementally along the mandrel by a feed carriage. The mandrel prevents the tube from collapsing under the force of the pilger dies while at the same time dictates the dimension of the tube inner diameter.

After cold-pilgering, each thin wall tube must be cut to a manageable length, since cold-pilgering greatly increases the length of the tube. The goal is to cut each tube to manageable lengths that will most closely yield a whole number multiple of the length of a finished thin wall tube after final cold-pilgering. However, allowance must also be made for waste (i.e. tube scrap) created by the cold-pilgering process.

One source of waste is the process under which successive thick wall tubes are loaded onto the feedbed of the cold-pilger mill. Cold-pilger mills operate with two thick wall tubes feeding forward at any point in time. The forward or "pushed" tube is the tube being passed over the tapered end of the mandrel and between the pilger dies. The rear tube is the "pusher" tube onto which the feed carriage clamps and advances forward towards the pilger dies. The rear or pusher tube pushes the forward tube between the pilger dies as the feed carriage advances. The mill must be stopped when the forward end of the pusher tube reaches the vicinity of the pilger dies to allow a new pusher tube to be loaded onto the mandrel at the inlet end of the feedbed. The pusher tube now becomes the pushed tube, or the tube to be cold-pilgered. When the dies are stopped to allow the new pusher tube to be loaded onto the mandrel, the stationary pressure exerted by the pilger dies against the portion of the tube positioned between the dies causes an uneven bulge in the tube wall which normally cannot be removed. Consequently, the bulged area must be cut off and becomes waste.

Various methods have heretofore been utilized in an attempt to insure that the reloading shutdown of the cold-pilgering mill occurs when the centerline between the pilger dies is as closely aligned with the facing ends of the pushed and pusher tubes as possible to minimize the length containing bulges that must be cut off. A first method involves the utilization of empirical data to predict and mark when the forward end of the pusher tube reached the centerline of the pilger dies. However, this method has only been reliable to within 18 inches of the abutting, or facing end portions of the pushed and pusher tubes. Another method involves the use of an eddy current sensing system intended to stop the advancement of the pushed tube at the correct time. However, this system has been found to be complex and extremely expensive.

Consequently, a need exists for an apparatus which may be utilized in combination with a cold-pilgering mill to provide an inexpensive, reliable and simple means for ensuring that cold-pilger mill shutdown occurs when the abutting or facing ends of the pushed and pusher tubes are in substantial alignment with the centerline between the pilger dies, regardless of the lengths of the pushed and pusher tubes. Stopping the operation of the cold-pilger mill in this manner will reduce the amount of tube scrap generated and thereby result in an increase in finished tube product yield. Increasing the finished tube product yield obviously results in a substantial material savings and an increase in additional salable tube product.

SUMMARY OF THE INVENTION

The present invention relates to an automatic cold-pilger mill stop apparatus designed to satisfy the aforementioned needs. The automatic cold-pilger mill stop apparatus of the present invention is operable to stop the cold-pilgering process when the rearward end of the pushed tube and the forward end of the pusher tube are in substantial alignment with the centerline extending between the pair of pilger dies at the rearward-most position of pilger dies' stroke. The automatic cold-pilger mill stop apparatus of the present invention is operable to stop the mill when the facing end portions of the pushed and pusher tubes are substantially aligned with the centerline between the pilger dies regardless of the lengths of the pushed and pusher tubes prior to cold-pilgering. Since the cold-pilgering process is stopped when the facing ends of the pushed and pusher tubes are substantially aligned with the centerline between the pilger dies, any bulging of the tubes which occurs as a result of static pressure exerted on the tubes by the dies will occur at the facing tube ends. This results in a reduction in the amount of scrap that would otherwise be generated if the dies were stopped when the facing end portions of the pushed and pusher tubes were not located between the dies.

Accordingly, the present invention is directed to an automatic stop apparatus for use in combination with a cold-pilger mill which enhances the operation of the pilger mill by reducing the amount of tube scrap generated during mill operation.

The cold-pilger mill itself includes a feedbed having inlet and outlet end portions, a pair of cold-pilger dies located at the feedbed outlet end portion and a mandrel above the feedbed having a tapered end portion positioned between the pair of pilger dies. A feed carriage is reciprocally movable along the feedbed between the feedbed inlet and outlet end portions, and is adapted to grasp a first or pusher tube positioned on the mandrel. A first drive device advances the feed carriage towards the feedbed outlet end portion and simultaneously operates the cold-pilger dies so that a second or pushed tube positioned on the mandrel and disposed between the first tube and the cold-pilger dies is driven between the dies by the first tube to allow the pilger dies to compress the wall of the second tube on the mandrel tapered end portion to form a thin wall tube. A second drive apparatus retracts the feed carriage towards the feedbed inlet end portion after the thin wall tube is formed so that the feed carriage may thereafter grasp a third tube placed on the mandrel between the feedbed inlet end portion and the first tube after the feed carriage is fully retracted and allow the process to be repeated. When the process is repeated, the first tube becomes the pushed tube and the third tube becomes the pusher tube.

The invention resides in a first control apparatus for stopping the advancement of the feed carriage and the operation of the cold-pilger dies when the feed carriage is a predetermined distance from the pair of pilger dies. The predetermined distance is selected to provide that the facing end portions of the first and second tubes (pusher and pushed tubes during a present cycle of operation of the cold-pilger mill) are positioned between the pilger dies. A second control apparatus is provided for stopping the retraction of the feed carriage after the feed carriage has moved the same predetermined distance measured from the end portion of the first tube opposite the facing end portions towards the feedbed inlet end portion so that a third tube thereafter positioned on the mandrel to abut the rearward end of the first tube and advanced by the feed carriage is stopped when facing end portions of the first and third tubes (pushed and pusher tubes during the next cycle of operation of the cold-pilger mill) are also positioned between the pilger dies.

These and other features and advantages of the present invention will become apparent to those skilled in the art upon a reading of the following detailed description when taken in conjunction with the drawing wherein there is shown and described an illustrative embodiment of the invention.

BRIEF DESCRIPTION OF THE DRAWING

In the course of the following detailed description, reference will be made to the attached FIGURE which is a side elevational, partial schematic view of a cold-pilger mill and an automatic cold-pilger mill stop apparatus which is the subject of the present invention operable in combination therewith to substantially reduce the amount of tube scrap generated by the cold-pilger mill.

DETAILED DESCRIPTION OF THE INVENTION

In General

Referring now to the FIGURE, there is shown a partial sectional view of a set of cold-pilger tooling, generally designated by the numeral 10, which forms a portion of a conventional cold-pilger mill to be described later herein in greater detail. The tooling 10, useful for cold reduction of a thin-walled tube such as the tubes T1, T2 or T3, includes an elongated stationarily-positioned mandrel 14 having a tapered end portion (not shown) positioned between a pair of upper and lower pilger dies 18, 20. The mandrel 14 supports the tubes T1, T2 and T3 thereon in position for cold reduction. The dies 18, 20 are positioned along opposing sides of the mandrel 14 in oppositely-facing relation to one another for coacting with the mandrel tapered end portion to reduce the cross-sectional size of each tube in a known manner.

The cold-pilgering operation in which the mandrel 14 and dies 18, 20 are employed is a conventional cold reducing process. The tubes T2, T1 and T3 are advanced over the mandrel 14 in succession as the latter is maintained stationary and simultaneously the tubes are successively compressed using the two opposing pilger dies 18, 20 and the tapered end portion of mandrel 14. Compression of each tube results in the reduction of the cross-sectional area and in elongation of each tube. Reduction is effected in both the diameter and wall thickness of each tube by means of the mandrel 14 tapered end portion and the circumferential tapered shape of the grooves 22, 24 formed in the pilger dies 18, 20 which embrace each of the tubes from above and below the mandrel 14 and roll in a constant cycle back and forth along the tube. Each cycle of pilger die movement results in the dies 18, 20 rolling back and forth over a stroke distance S between the position shown in solid to the position shown in phantom. Between each cycle of die movement, a tube such as one of the tubes T1, T2 or T3 is advanced and rotated incrementally along the mandrel 14 by a suitable conventional mechanism which will be explained later in greater detail. The mandrel 14 prevents each of the tubes from collapsing under the force of the pilger dies 18, 20 while at the same time dictates the inner diameter of the tube 12.

As seen in the FIGURE, the pilger tooling 10 is employed in a cold-pilger mill generally designated by the numeral 30. The pilger mill 30, which is illustrated partially in schematic in the FIGURE and in side elevation, includes a feedbed 32 having an inlet end portion 34 and an outlet end portion 36. The feedbed 32 itself is positioned on a base 38. A feed and turn gear box 40 is positioned at the inlet end portion 34 of the feedbed 32 and an idler support stand 42 is positioned at the outlet end portion 36 of the feedbed 32.

The pair of upper and lower pilger dies 18, 20 are positioned within the idler support stand 42. The mandrel 14 has an end portion 44 extending into and connected in a well known manner with the feed and turn gear box 40. The opposite, tapered end portion of the mandrel 14 (not shown) is positioned between the pair of upper and lower pilger dies 18, 20. A lead screw 46 and a stabilizing bar 48 each extend between the feed and turn gearbox 40 and the idler support stand 42. A feed carriage 50 positioned on the feedbed 32 threadedly engages the lead screw 46 via a lug 52 extending therefrom which has an opening therein threaded to match the thread pattern on the lead screw 46. The feed carriage 52 includes a second lug 54 extending from the feed carriage 50 and having an opening therein (not shown) for receiving the stabilizer bar 48. Rotation of the lead screw 46 in a selected direction by operation of the feed and turn gearbox 40 allows the feed carriage 50 to move in reciprocating fashion on the feedbed 32 between the feedbed inlet and outlet end portions 34, 36. The stabilizer bar 48 provides support for the feed carriage 50 as it moves along the feedbed 32.

The feed carriage 50 is operable to clamp to or grasp a first tube T1 and, via rotation of the lead screw 46 in the proper direction, advance towards the outlet end portion 36 of the feedbed 32. As the feed carriage 50 advances towards the outlet end portion 36, the tube T1 pushes the tube T2 between the upper and lower pilger dies 18, 20 and over the tapered end portion of the mandrel 14 to, reduce the cross-sectional area of and elongate the tube T2 as the upper and lower pilger dies 18, 20 roll back and forth over the stroke distance S between their rearward and forward positions. During cold-pilgering of tube T2, the tube T1 is referred to as the pusher tube and the tube T2 is referred to as the pushed tube. After the feed carriage 50 has advanced in a forward direction to allow tube T1 to push tube T2 substantially through the pilger tooling 10, the tube T1 is released from the feed carriage 50 and the rotation of the lead screw 46 is reversed to retract the feed carriage 50 rearwardly in a direction towards the inlet end portion 34 of the feedbed 32. After retraction, the feed carriage 50 grasps a third tube T3 placed on the mandrel 14 and the rotational direction of the lead screw 46 is again reversed to advance the feed carriage 50 towards the pilger tooling 10. In this manner, successive tubes T1, T2, T3 . . . Tn are cold-pilgered by the pilger mill 30.

Automatic Stop Apparatus of the Present Invention

Again referring to the FIGURE, there is illustrated an automatic stop apparatus generally designated by the numeral 60 operable in combination with the pilger mill 30 to reduce the amount of tube scrap generated during the cold-pilgering operation. The stop apparatus 60 includes a first control scheme 62 for stopping the movement of the feed carriage 50 as the feed carriage 50 advances towards the pilger tooling 10, and a second control scheme 64 for controlling the position along the feedbed 32 at which the retraction of the feed carriage 50 is stopped as the feed carriage 50 moves in a direction towards the feedbed 32 inlet end portion 34. The first and second control schemes 62, 64 operate in combination to assure that the facing end portions 66, 68 of the tubes T1 and T2, and the facing end portions 70, 72 of the tubes T1, T3 are substantially aligned with the axis or centerline 74 extending between the centers of the upper and lower pilger dies 18, 20 when successive advancements of the feed carriage 50 along the feedbed 32 are stopped upon cold pilgering tube T2 and thereafter cold-pilgering tube T1, regardless of the lengths of the tubes T1 and T2.

In order to initially calibrate the stop apparatus 60, the feed carriage 50 grasps the tube T1 and advances forward along the feedbed 32 in a direction towards the feedbed outlet end portion 36 until the facing end portions 66, 68 of tubes T1, T2 are in substantial alignment with the axis 74 extending between the pilger dies 18, 20. The feed carriage 50 is stopped at this point. After the forward advancement of the feed carriage 50 is stopped, the distance A between the center of the feed carriage 50 and the axis 74 is measured. A first control scheme 62 which includes a first sensor 75 in the form of a limit switch (or other suitable device) secured to the feedbed 32 is adjusted so that the feed carriage 50 trips the first sensor 75 in this stopped position. Subsequent advancements of the feed carriage 50 will be stopped at the same position along the feedbed 32 by the first sensor 75. Stoppage of the feed carriage 50 advancement is effected as follows. When the first sensor 75 is tripped, contacts (not shown) within the first sensor 75 change state and cause a signal to be generated by a controller 76 in the form of a programmable logic controller. The contacts of the limit switch 75 are electrically connected with the programmable logic controller 76 via an electrical conductor 77. The signal generated by the programmable logic controller 76 is a feed carriage 50 advance stop signal. The stop signal is provided to a motor controller 78 which controls the operation of a motor 80. The motor 80 drives the schematically illustrated gear units 82, 84 to operate the upper and lower pilger dies 18, 20 and forwardly advance the feed carriage 50 by feed and turn gearbox 40. Stopping the motor 80 stops both the operation of the upper and lower pilger dies 18, 20 and the advancement of the feed carriage 50.

In order to minimize the amount of tube scrap generated during the cold-pilgering operation, the location along the feedbed 32 at which the rearward retraction of the feed carriage 50 is stopped and a new pusher tube (in this case the tube T3) is engaged must also be controlled to ensure that the facing end portions of subsequent pushed and pusher tubes are also in substantial alignment with the axis 74 between the upper and lower pilger dies 18, 20 when subsequent forward advancement of the feed carriage 50 is stopped. It has been found that stopping the advancement of the feed carriage 50 a distance A from axis 74 to cause the facing end portions 66, 68 of the tubes T1, T2 to lie substantially along the axis 74 is insufficient in and of itself to assure that the facing end portions 70, 72 of the tubes T1, T3 will also be in substantial alignment with the axis 74 when the next advancement of the feed carriage 50 is stopped unless the feed carriage 50 grasps the tube T3 at the same distance A measured from the end portion 70 of the tube T1 opposite the facing end portions 66, 68 in a direction towards the inlet end portion 34 of the feedbed 32.

In order to assure that the distance A is maintained each time the feed carriage 50 retracts rearwardly in order to grasp a new pusher tube (in this case the tube T3), a second control scheme 64 which includes a second sensor 88 positioned on the feed carriage 50 is utilized. The second sensor 88 is a limit switch having a plunger arm 90 spring-loaded to contact the outer surface of the tube T1 as the feed carriage 50 is retracted after cold-pilgering the tube T2.

As the feed carriage 50 is retracted from the position illustrated in solid to the position illustrated in phantom in the FIGURE, the spring-loaded plunger arm 90 of the sensor 88 moves along the outer surface of the tube T1. The plunger arm 90 is extended by spring action when it passes over the end portion 70 of the tube T1 (extended plunger arm 90 shown in phantom). When the plunger arm 90 is extended, a set of contacts (not shown) within the second sensor 88 change state and cause the programmable logic controller 76 to receive a series of pulses generated by a pickup head 94 positioned adjacent to an indicator wheel 96 fixed to the lead screw 46. The contacts of the second sensor 88 are electrically connected with the programmable logic controller 76 via an electrical conductor 89. The pickup head 94/indicator wheel 96 combination is itself known in the art. The indicator wheel 96 has at least one protuberance formed on its circumferential surface, and each time the protuberance passes in proximity to the pickup head 94, the pickup head 94 generates a pulse.

The series of pulses generated by the pickup head 94 are passed through the programmable logic controller 76 to a counter 98 which counts the number of pulses generated by the pickup head 94 as the feed carriage 50 is retracted toward the inlet end portion 34 of the feedbed 32. The pulses provided to the counter 98 are compared within the counter 98 to a reference number representative of the predetermined distance A measured from the end portion 70 of the tube T1 towards the inlet end portion 34 of the feedbed 32. The reference number is provided to the counter at input 102. When the reference number equals the number of pulses actually counted by the counter 98 (indicating that feed carriage 50 has retracted rearwardly the distance A from the end portion 70 of the tube T1), the counter 98 provides a carriage retract stop signal to a motor controller 104. The motor controller 104, which controls the operation of the feed carriage retract motor 106 and the feed carriage retract gear unit schematically illustrated by the numeral 108, stops the retraction of the feed carriage 50. After the retraction of the feed carriage 50 is stopped, the tube T3 is positioned on the mandrel 14 so that its end portion 72 abuts the end portion 70 of the tube T1. The feed carriage 50 grasps the tube T3 and the cold-pilgering of the tube T1 is commenced by advancing the feed carriage 50 towards the pilger tooling 10.

As described, so long as successive "pusher" tubes are capable of being grasped by the feed carriage 50 each at a distance A measured from the end of the previous pusher tube towards the inlet end portion 34 of the feedbed by operation of second control scheme 64, successive advancements of the pusher tube will be stopped by the first control scheme 62 when the facing ends of the pusher and pushed tubes are in substantial alignment with the axis 74 between the upper and lower pilger dies 18, 20. The overall lengths of the tubes to be cold-pilgered are not a concern since the distance X, for example, between the feed carriage 50 and the end portion 70 of the tube T1 is not measured during retraction of the feed carriage 50. Thus, random length tubes may be passed through the cold pilger tooling 10 in succession without generating excessive scrap due to stoppage of the feed carriage 50 advancement when the abutting end portions of the pusher and pushed tubes are not between the pilger dies 18, 20.

It is thought that the present invention and many of its attendant advantages will be understood from the foregoing description and it will become apparent that various changes may be made in the form, construction and arrangement of the parts of the invention described herein without departing from the spirit and scope of the invention or sacrificing all of its material advantages, the forms hereinbefore described at being merely preferred or exemplary embodiments thereof.

We claim:

1. In a pilger mill including a feedbed having inlet and outlet end portions, a pair of pilger dies at the feedbed outlet end portion and positioned so that a center of each of said pilger dies lies along an axis substantially perpendicular to said feedbed, a mandrel above the feedbed and having a tapered end portion positioned between the pair of pilger dies, a feed carriage reciprocally movable along the feedbed between the feedbed inlet and outlet end portions and adapted to grasp a first tube of first predetermined length and positioned on the mandrel, first drive means for advancing the feed carriage towards the feedbed outlet end portion and simultaneously operating the pilger dies so that a second tube of second predetermined length and having a wall and positioned on the mandrel which is disposed between the first tube and the pilger dies is driven between the pilger dies by the first tube to allow the pilger dies to compress the wall of the second tube on the mandrel tapered end portion to form a thin wall tube, and second drive means for retracting the feed carriage towards the feedback inlet end portion after the thin wall tube is formed so that the feed carriage may thereafter grasp a third tube of third predetermined length and placed on the mandrel between the feedbed inlet end portion and the first tube, the improvement comprising:

first control means for stopping the advancement of said feed carriage and the operation of said pilger dies when said feed carriage is a predetermined distance A from said pair of pilger dies which is selected to provide that facing end portions of said first and second tubes are positioned between said pilger dies and in substantial alignment with said axis; and second control means for stopping the retraction of said feed carriage after said feed carriage has moved the same predetermined distance A measured from the end portion of said first tube opposite said facing end portions towards said feedbed inlet end portion so that subsequent advancement of said feed carriage and said third tube is also stopped when facing end portions of said first and third tubes are also positioned between said pilger dies and in substantial alignment with said axis regardless of said first and third predetermined lengths of said first and third tubes.

2. The pilger mill as recited in claim 1, wherein said first control means includes:

first sensor means for detecting when said feed carriage has advanced to a location said predetermined distance A from said axis extending through said centers of said pair of pilger dies; and a control device operable in response to said first sensor means to provide a signal to said first drive means which causes said first drive means to stop the advancement of said feed carriage and the operation of said pilger dies.

3. The pilger mill as recited in claim 2, wherein said first sensor means is a limit switch.

4. The pilger mill as recited in claim 3, wherein said feed sensor means is located on said feedback.

5. The pilger mill as recited in claim 2, wherein said control device is a programmable logic controller.

6. The pilger mill as recited in claim 1, wherein said second control means includes:

includes second sensor means for detecting when said feed carriage has retracted a distance sufficient to begin passing over said third tube;

pulse generating means operable in response to said second sensor means to generate a number of pulses as said feed carriage is retracted over a length of said third tube proportional to the distance travelled by said feed carriage over said third tube; and counter means for counting the number of pulses generated by said pulse generating means, comparing the number of pulses counted to a reference number representative of said predetermined distance A and providing a signal to stop the retraction of said feed carriage when said number of counted pulses equals said reference number.

7. The pilger mill as recited in claim 6, wherein said second sensor means is a limit switch.

8. The pilger mill as recited in claim 7 wherein said second sensor means is mounted on said feed carriage.

9. The pilger mill as recited in claim 6, wherein:

said feed carriage is retracted by operation of a rotatable lead screw threadedly coupled thereto and extending along said feedbed;

said pulse generating means includes an indicator wheel fixed on said lead screw and rotatable therewith; and a pickup head positioned adjacent to said indicator wheel and operable to generate on of said pulses each time a preselected point on said indicator wheel passes in proximity to said pickup head.

10. A pilger mill, comprising:

a feedbed having inlet and outlet end portions;

a pair of pilger dies at the feedbed outlet end portion and positioned so that a center of each of said pilger dies lies along an axis substantially perpendicular to said feedbed;

a mandrel above the feedbed and having a tapered end portion positioned between the pair of pilger dies;

a feed carriage reciprocally movable along the feedbed between the feedbed inlet and outlet end portions and adapted to grasp a first tube of first preselected length and positioned on said mandrel;

first drive means for advancing the feed carriage towards the feedbed outlet end portion and simultaneously operating said pilger dies so that a second tube of second predetermined length and having a wall and positioned on said mandrel which is disposed between said first tube and said pilger dies is driven between the pilger dies by said first tube to allow said pilger dies to compress said second tube on said mandrel tapered end portion to form a thin wall tube;

second drive means for retracting said feed carriage towards said feedbed inlet end portion after said thin wall tube is formed so that said feed carriage may thereafter grasp a third tube of third predetermined length and placed on said mandrel between said feedbed inlet end portion and said first tube;

first control means for stopping the adancement of said feed carriage and the operation of said pilger dies when said feed carriage is a predetermined distance A from said pair of pilger dies which is selected to provide that facing end portions of said first and second tubes are positioned between said pilger dies and in substantial alignment with said axis; and second control means for stopping the retraction of said feed carriage after said feed carriage has moved the same predetermined distance A measured from the end portion of said first tube opposite said facing end portions towards said feedbed inlet end portion so that subsequent advancement of said feed carriage and said third tube is stopped when facing end portions of said first and third tubes are also positioned between said pilger dies and in substantial alignment with said axis regardless of said first and third predetermined lengths of said first and third tubes.

11. A method for operating a pilger mill having a feedbed with inlet and outlet end portions, a pair of pilger dies at the feedbed outlet end portion and positioned so that a center of each of said pilger dies lies along an axis substantially perpendicular to said feedbed, a mandrel above the feedbed and having a tapered end portion positioned between the pair of pilger dies and a feed carriage reciprocally movable along the feedbed between the feedbed inlet and outlet end portions in a manner to reduce tube scrap generated by said pilger mill, comprising the steps of:

grasping a first tube of first preselected length and positioned on said mandrel with said feed carriage;

advancing said feed carriage and said first tube towards said feedbed outlet end portion and simultaneously operating said pilger dies so that a second tube of second predetermined length which has a wall, is positioned on said mandrel and is disposed between said first tube to allow said pilger dies is driven between said pilger dies by said first tube to allow said pilger dies to compress said wall of said second tube on said mandrel tapered end portion to form a thin wall tube;

stopping the advancement of said feed carriage and the operation of said pilger dies when said feed carriage is a predetermined distance A from said pair of pilger dies, said predetermined distance A selected to provide that facing end portions of said first and second tubes are positioned between said pilger dies and in substantial alignment with said axis;

releasing said first tube from said feed carriage;

thereafter retracting said feed carriage towards said feedbed inlet end portion so that said feed carriage may be positioned to grasp a third tube of third predetermined length and placed on said mandrel between said feedbed inlet end portion and said first tube;

stopping the retraction of said feed carriage after said feed carriage has moved the same predetermined distance A measured from the end portion of said first tube opposite said facing end portions towards said feedbed inlet end portion; and grasping said third tube with said mandrel after said mandrel after said mandrel has retracted said predetermined distance A so that subsequent advancement of said feed carriage and said third tube is stopped when facing end portions of said first and third tubes are also positioned between said pilger dies and in substantial alignment with said axis regardless of said first and third predetermined lengths of said first and third tubes.

* * * * *